US006431230B1

(12) United States Patent
Tsigas

(10) Patent No.: US 6,431,230 B1
(45) **Date of Patent: *Aug. 13, 2002**

(54) YARD WASTE STORAGE AND DISPOSAL SYSTEM

(76) Inventor: Panagiotis Tsigas, 24 Longworth Rd., Worcester, MA (US) 01602

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/161,642

(22) Filed: Sep. 28, 1998

(51) Int. Cl.[7] ..... B65B 1/04

(52) U.S. Cl. ..... 141/391; 141/316; 141/10; 248/99

(58) Field of Search ..... 428/35.2, 34.2, 428/34.3; 220/495.08, 495.11, 495.05; 383/117; 248/99; 141/391, 313–319, 10, 114

(56) References Cited

U.S. PATENT DOCUMENTS 1,635,844 A * 7/1927 Hoffmann
2,827,931 A * 3/1958 Melvin
3,747,653 A * 7/1973 Ringer ..... 150/1
4,338,979 A * 7/1982 Dow
5,031,277 A * 7/1991 Coker ..... 15/257.3
5,593,117 A * 1/1997 Alexander, III ..... 248/99
5,740,939 A * 4/1998 Muldner et al. ..... 220/404

* cited by examiner

*Primary Examiner*—Steven O. Douglas
(74) *Attorney, Agent, or Firm*—Mirick, O'Connell, DeMallie & Lougee, LLP

(57) ABSTRACT

A yard waste storage and disposal system which includes a free-standing frame defining an interior volume, the frame being substantially open at the top and at least partially open at the bottom. The system also includes a compliant bag-like member which is large enough to line the entire inside of the frame and overlap at least some of the outside of the frame at its top, and which spans the frame bottom, to define an interior yard waste collection volume. The compliant member has a substantial number of openings to allow rain water to pass therethrough.

9 Claims, 2 Drawing Sheets

YARD WASTE STORAGE AND DISPOSAL SYSTEM

FIELD OF INVENTION

This invention relates to a yard waste storage disposal system which is ideally suited for collection and biodegradable disposal of yard waste including leaves, sticks, and other organic matter.

BACKGROUND OF THE INVENTION

Yard waste such as leaves and small sticks are typically collected and disposed of in plastic or paper bags. In either case, the bags are relatively weak and can easily tear by use of too much force to pack the bags, or sticks and the like protruding through the bags. Additionally, plastic is not biodegradable, and plastic bags filled with yard waste thus cannot be disposed of as a whole as a biodegradable waste. Even the paper bags biodegrade relatively slowly. And, paper bags when wet from wet leaves or rain easily tear and fall apart.

Another problem with use of bags is that they are awkward to hold open and fill. Open metal frame devices have been developed to hold open plastic bags. However, the result is unsatisfactory for the reasons stated above, and further that the bag cannot be stuffed with any substantial pressure, because the sides or top of the bag will simply rip. Accordingly, these bags cannot be used to hold a substantial weight of yard waste. Also, the bags, even when placed in the frame, can easily tip or blow over, and thus cannot be left for any amount of time so that they can be slowly filled.

SUMMARY OF THE INVENTION

It is therefore an object of this invention to provide a yard waste storage and disposal system which solves the above noted problems by providing a free-standing frame defining an interior volume, and being substantially open at both the top and the bottom. The system also includes a compliant bag-like member large enough to line the entire inside of the frame and overlap at least some of the outside of the frame at its top, and which spans the frame bottom, to define an interior yard waste collection volume. The compliant member has a substantial volume of openings in it to allow rain water to pass therethrough so that it does not retain the water.

The result of this system is a yard waste collector which can be filled over time and left alone for a substantial time, since it is free standing and sturdy. The sturdiness also allows the waste to be packed down tightly, so that more mass of waste can be held in the bags, thus using fewer bags. When the bag-like members are full, they can be removed from the frame and tied or closed from the top. Since the entire bag-like member and its contents are biodegradable, it can simply be disposed of in a landfill or even in a homeowners yard, and left to biodegrade. Since the bag-like member is substantially open (preferably made of a biodegradable netting), the system can effectively be used as a composter, or at the very least can be left in place for a substantial amount of time and filled over the course of days or weeks depending on the frequency of yard clean up and the amount of yard waste to be cleaned up.

BRIEF DESCRIPTION OF THE DRAWINGS

Other objects, features and advantages will occur to those skilled in the art from the following description of preferred embodiments, and the accompanying drawings, in which.

DESCRIPTION OF THE PREFERRED EMBODIMENTS

This invention features a yard waste storage and disposal system. The system of this invention may be accomplished with a free-standing frame which defines an interior volume which is used to collect the yard waste. The frame is substantially open at the top and at least partially open at the bottom (preferably fully open). A compliant bag-like member which is large enough to line the entire inside of the frame and overlap at least some of the outside of the frame at its top, completes the system. This compliant member is placed in the frame such that it lines the inside walls of the frame and spans the frame bottom and thereby accomplishes a receptacle for yard waste. The compliant member has a substantial volume of openings to allow rain water to pass through it.

Figure 1:
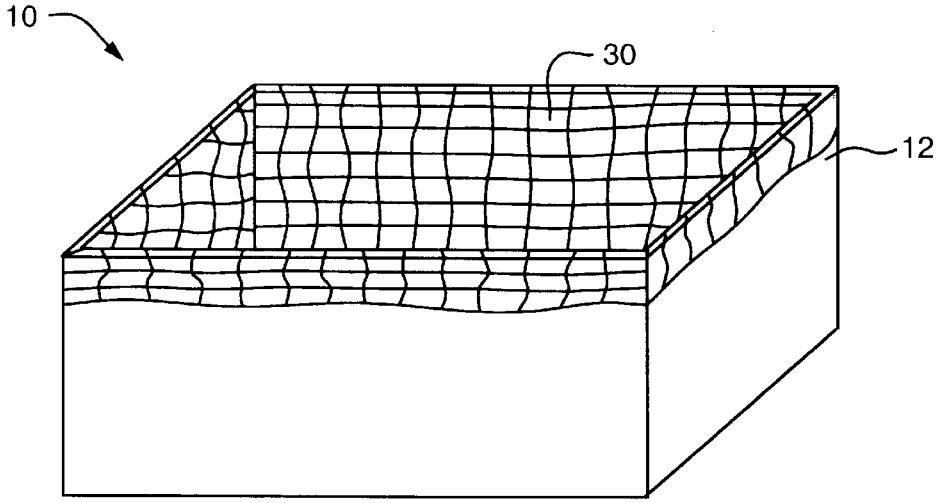
FIG. 1 is a three dimensional view of one embodiment of a free-standing frame and compliant member for the yard waste storage and disposal system of this invention.
Figure 2A:
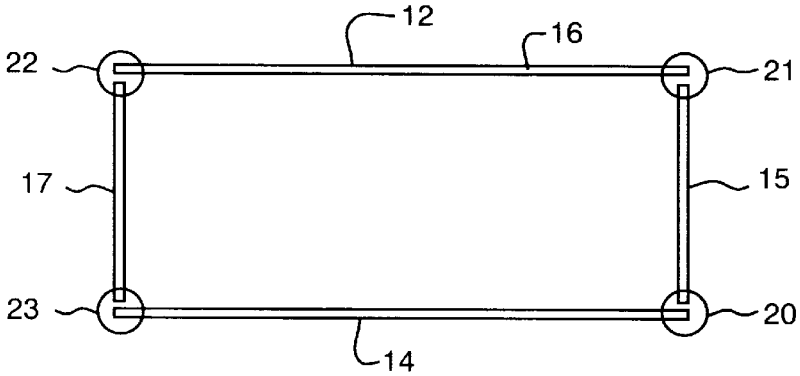
FIG. 2A is a top view of another embodiment of a free-standing frame for this invention, detailing the preferred manner in which the frame is constructed, and the frame members interconnected.
Figure 2B:
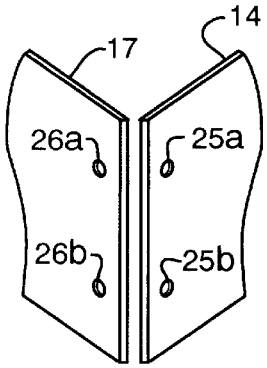
FIG. 2B is a partial view of two of the frame members of the frame of FIG. 2A, which conveys more information regarding the manner in which the frame members of FIG. 2A are interconnected.

There is shown in FIG. 1 yard waste storage and disposal system 10 according to this invention. System 10 includes free-standing frame 12 and biodegradable compliant bag-like member 30 which in this case is a properly sized piece of biodegradable netting material. Frame 12 is preferably made from substantially solid and rigid sidewalls, which may be accomplished with plastic sheeting material. In the preferred embodiment, the four sides are arranged to accomplish a rectangular open bottom and top box 32 inches long, 18 inches high, and 20 inches wide, made of four pieces of one quarter inch thick plastic interconnected in an appropriate manner. Frame 12 is shown as made from four plastic panels welded or adhered together to form a rigid frame. In contrast, frame 10*a,* FIG. 2A, is made from frame members 14–17. Abutting edges of panels 14–17 are interconnected in an appropriate manner with mechanical fasteners, such tie wraps 20–23. These tie wraps would fit through holes 25A, 25B, and 26A, 26B, FIG. 2B. This type of interconnection would allow frame 12 to be more easily stored when not in use by removal of the tie wraps or mechanical connectors along one edge, which would allow the entire frame to be folded flat. Also, the frames could be stacked flat at retail, and assembled by the purchaser. Additionally or alternatively, frame 10 may be tapered slightly from top to bottom so that a number of frames can be nested together for storage in retail locations and at their point of use, although the rectangular shape is preferred due to ease of manufacture, and because the shape is more stable when placed on the ground.

Figure 3:
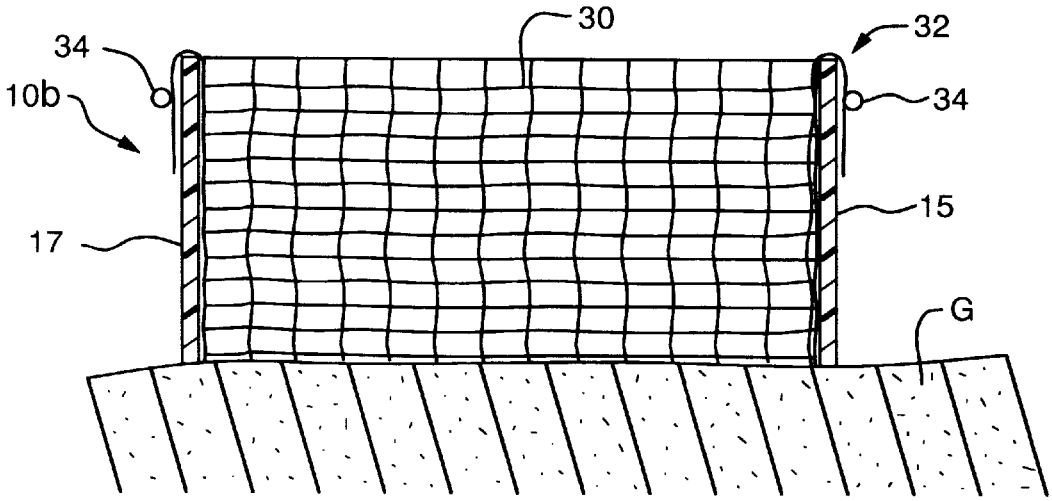
FIG. 3 is a cross-sectional view of an embodiment of both the frame and the compliant bag-like member of this invention, showing the manner in which the system is used, and a preferred embodiment of the manner in which the compliant member is removably held to the frame.

The preferred manner in which the compliant member is used with and removably held to the frame is shown in the cross sectional view of FIG. 3. Biodegradable netting member 30 lines the inside of each of the four walls of frame 10*b* and overlaps some of the outside of frame 10*b* at area 32. Elastic band 34 is stretched around the entire top periphery of frame 10*b* to removably hold compliant member 30 in place. Since member 30 lies on ground G, when yard waste is placed into lined frame 10*b,* there is little or no force tending to pull member 30 from elastic band 34. In fact, yard waste can be packed as tightly as desired, since the frame is relatively rigid and there is virtually no force translated to the compliant member which may tear it. This feature allows a large volume of yard waste to be placed and stored within frame 10*b* before it is filled, thus decreasing the number of containers of yard waste which must be disposed of as compared to the traditional plastic and paper bags. Also, because the frame is open at the top and bottom, and a netting is used for collection of yard waste, water does not collect in the waste, which keeps the waste lighter and also allows the system to be left in place for as much time as necessary need to fill the compliant member.

Compliant member 30 is preferably a netting made from biodegradable jute twine, such as that made by Amalgamated Cordage Corp. of Port Washington, N.Y., Cat. # JT3206. The netting should be about at least 6' by 5½' with openings of about 2½ to 3 inches in order to keep leaves in the netting while providing a substantial amount of open area so that rain can pass through and so that sticks and other matter can be more easily fitted into the compliant member. The netting could alternatively be made of other materials, such as a typical plastic or a rope netting. When the compliant member is sufficiently full, the diametrically opposed corners are brought together across the open top of the frame, and then tied, to close the compliant member into a bag-like member. This can then be removed from the frame and disposed of or moved to another location if the bag is not yet full. Since the entire bag and its contents are biodegradable, disposal can take place anywhere where biodegradable wastes are disposed of.

The invention can also be used for storage of other items, whether biodegradable or not. Additionally the frame members need not be solid as long as they are sufficiently rigid for the application.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A method of collecting yard waste, comprising;

providing yard waste storage and disposal system, comprising, a free-standing frame made from plastic sheeting and defining an interior volume, said frame substantially open at the top, and at the bottom; and placing said frame top-side up on the ground;

adding to said frame a compliant member large enough to line the entire inside of said frame and overlap at least some of the outside of the frame at its top, and spanning the frame bottom, to define an interior yard waste collection volume, said compliant member made of a netting having openings to allow rain water to pass therethrough, so that it does not retain the water; and adding yard waste into said interior volume through the top of said frame.

2. The method of claim 1, wherein the netting is made of a biodegradable material.

3. The method of claim 1, wherein the netting defines openings of at least 2½ inches.

4. The method of claim 1, wherein said frame is substantially rectangular.

5. The method of claim 4, wherein the sidewalls are separate members that are interconnected.

6. The method of claim 4, wherein at least two of the sidewalls are connected by a living hinge.

7. The method of claim 4, wherein the frame is slightly tapered from the top to the bottom.

8. The method of claim 1, further comprising removably coupling the compliant member to the outside of the frame before adding yard waste.

9. A method of collecting yard waste, comprising:

providing a yard waste storage and disposal system comprising a substantially rectangular free-standing frame made from four interconnected sidewalls, and defining an open top and bottom;

placing the frame top-side up on the ground;

placing into the frame interior a compliant member large enough to line the entire inside of the frame and overlap at least some of the outside of the frame at its top, and spanning the frame bottom, to define an interior yard waste collection volume, the compliant member made of a biodegradable netting having openings to allow rain water to pass therethrough, so that it does not retain the water; and adding yard waste into the interior volume through the top of the frame.

* * * * *